US011175610B2

(12) United States Patent
Kumagai et al.

(10) Patent No.: US 11,175,610 B2
(45) Date of Patent: Nov. 16, 2021

(54) IMAGE FORMING APPARATUS

(71) Applicants: Naohiro Kumagai, Kanagawa (JP); Kazuhiko Watanabe, Kanagawa (JP)

(72) Inventors: Naohiro Kumagai, Kanagawa (JP); Kazuhiko Watanabe, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/224,127

(22) Filed: Apr. 7, 2021

(65) Prior Publication Data

US 2021/0325802 A1 Oct. 21, 2021

(30) Foreign Application Priority Data

Apr. 15, 2020 (JP) ..... JP2020-072937

(51) Int. Cl.
*G03G 15/16* (2006.01)
*G03G 21/00* (2006.01)

(52) U.S. Cl.
CPC ..... *G03G 15/161* (2013.01); *G03G 21/0017* (2013.01)

(58) Field of Classification Search
CPC ..... G03G 15/161; G03G 21/0017
See application file for complete search history.

(56) References Cited

U.S. PATENT DOCUMENTS 6,175,712 B1 1/2001 Masuda et al.
2005/0196196 A1* 9/2005 Ota ..... G03G 5/147 399/159
2005/0238988 A1 10/2005 Sugahara et al.
2008/0304878 A1* 12/2008 Matayoshi ..... G03G 15/0131 399/302
2012/0063827 A1 3/2012 Kumagai
2014/0119769 A1 5/2014 Kikuchi et al.
2014/0341629 A1 11/2014 Watanabe et al.
2016/0109846 A1 4/2016 Shimizu et al.
2016/0259293 A1 9/2016 Shimizu et al.
2017/0038724 A1 2/2017 Shimizu et al.
2017/0068207 A1 3/2017 Shimizu et al.
2017/0146944 A1 5/2017 Shimizu et al.
(Continued)

FOREIGN PATENT DOCUMENTS

EP 1 503 248 A2 2/2005
JP 2005-250455 9/2005
JP 2016-206373 12/2016

OTHER PUBLICATIONS

Extended European Search Report dated Jul. 26, 2021 in European Patent Application No. 21167597.0, 7 pages.

*Primary Examiner* — Clayton E. LaBalle
*Assistant Examiner* — Michael A Harrison
(74) *Attorney, Agent, or Firm* — Xsensus LLP

(57) ABSTRACT

An image forming apparatus includes a plurality of image bearers and a rotatable transferor. Images borne on the plurality of image bearers are transferred to the transferor. The transferor has an elastic power larger than an elastic power of each of the plurality of image bearers, and a difference in elastic power between the transferor and a most upstream image bearer in a rotation direction of the transferor is smaller than a difference in elastic power between the transferor and any other image bearer except the most upstream image bearer of the plurality of image bearers.

9 Claims, 3 Drawing Sheets

(56) References Cited

U.S. PATENT DOCUMENTS

| | | | |
|---|---|---|---|
| 2017/0199493 | A1 | 7/2017 | Watanabe et al. |
| 2018/0196387 | A1 | 7/2018 | Watanabe |
| 2021/0034010 | A1 | 2/2021 | Watanabe et al. |

* cited by examiner

IMAGE FORMING APPARATUS

CROSS-REFERENCE TO RELATED APPLICATION

This patent application is based on and claims priority pursuant to 35 U.S.C. § 119(a) to Japanese Patent Application No. 2020-072937, filed on Apr. 15, 2020, in the Japan Patent Office, the entire disclosure of which is incorporated by reference herein.

BACKGROUND

Technical Field

Embodiments of the present disclosure generally relate to an image forming apparatus.

Related Art

There are image forming apparatuses such as a copier, a printer, a facsimile machine, and a multifunctional machine having two or more of copying, printing, and facsimile functions. Such an image forming apparatus forms a toner image on a photoconductor, transfers the toner image onto a transferor such as a transfer belt, and transfers the toner image onto a recording medium.

SUMMARY

This specification describes an improved image forming apparatus that includes a plurality of image bearers and a rotatable transferor. Images borne on the plurality of image bearers are transferred to the transferor. The transferor has an elastic power larger than an elastic power of each of the plurality of image bearers, and a difference in elastic power between the transferor and a most upstream image bearer in a rotation direction of the transferor is smaller than a difference in elastic power between the transferor and any other image bearer except the most upstream image bearer of the plurality of image bearers.

This specification further describes an improved image forming apparatus that includes a plurality of image bearers including a black image bearer configured to bear a black image and a transferor. Images borne on the plurality of image bearers are transferred to the transferor. The transferor has an elastic power larger than an elastic power of each of the plurality of image bearers, and a difference in elastic power between the transferor and the black image bearer is larger than a difference in elastic power between the transferor and any other image bearer except the black image bearer.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
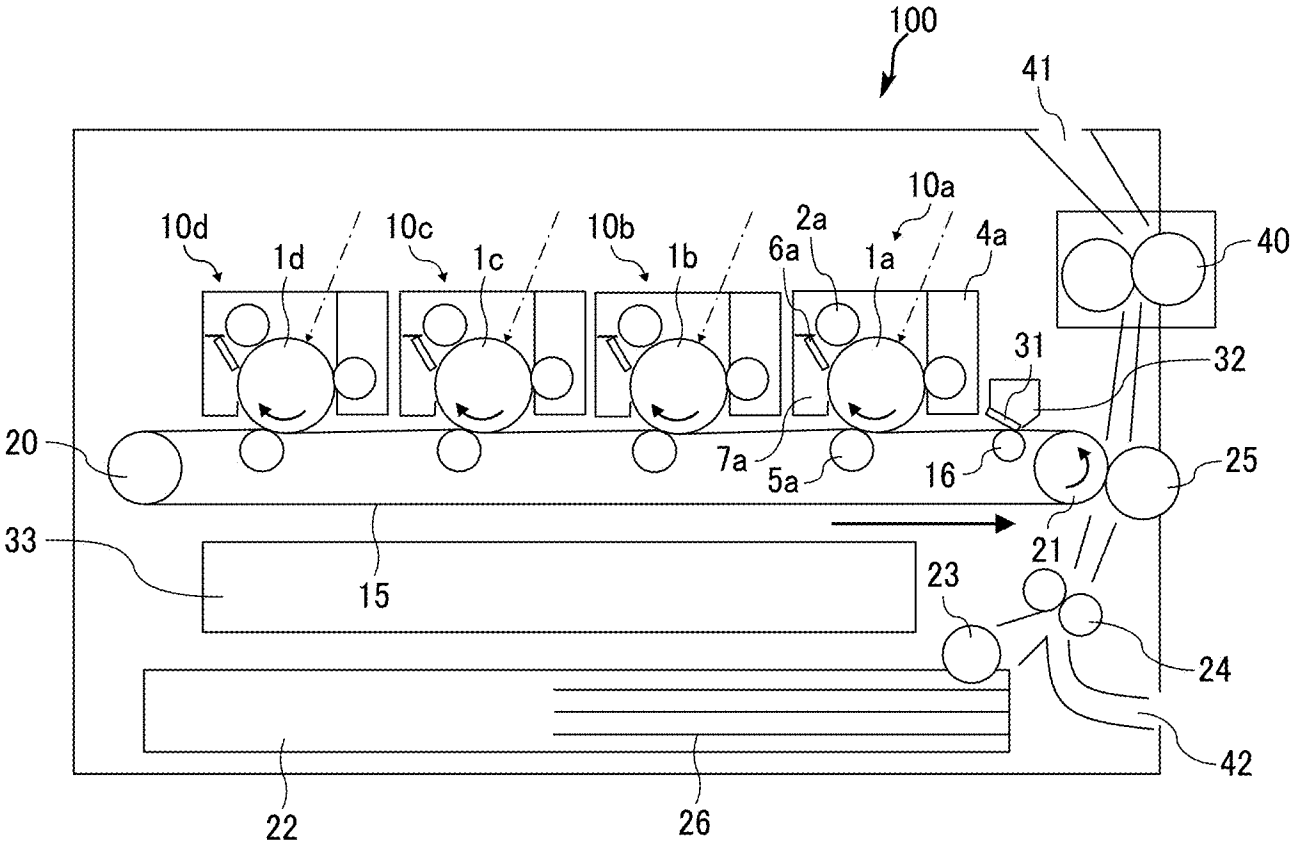
FIG. 1 is a schematic view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Referring now to the drawings, embodiments of the present disclosure are described below. As used herein, the singular forms "a," "an," and "the" are intended to include the plural forms as well, unless the context clearly indicates otherwise. Identical reference numerals are assigned to identical components or equivalents and a description of those components is simplified or omitted.

A description is provided of an image forming apparatus according to the present disclosure with reference to drawings. It is to be noted that the present disclosure is not to be considered limited to the following embodiments, but can be changed within the range that can be conceived of by those skilled in the art, such as other embodiments, additions, modifications, deletions, and the scope of the present disclosure encompasses any aspect, as long as the aspect achieves the operation and advantageous effect of the present disclosure.

First Embodiment

An image forming apparatus according to the present embodiment includes a plurality of image bearers and a rotatable transferor to which images borne by the plurality of image bearers are transferred. An elastic power of the transferor is larger than an elastic power of each of the plurality of image bearers, and a difference in elastic power between the transferor and the image bearer disposed on the most upstream side in a rotation direction of the transferor, that is, the most upstream image bearer of the plurality of image bearers, is smaller than a difference in elastic power between the transferor and any other image bearer except the most upstream image bearer.

The transferor in the image forming apparatus according to the present embodiment is, for example, a transfer belt to which a visible image (also referred to as a toner image) borne by the image bearer (for example, a photoconductor) is transferred. In the present embodiment, a transfer belt is described as an example of the transferor.

FIG. 1 is a schematic view illustrating an example of the image forming apparatus according to the present embodiment.

The image forming apparatus 100 according to the present embodiment includes a process unit 10 in which a photoconductor 1, a charger 2, a developing device 4, and a photoconductor cleaner 7 are integrated. Four process units 10 are arranged in parallel and used as, for example, process units for black, cyan, magenta, and yellow. When the image forming apparatus 100 forms a full-color image, the visible images of the respective colors are transferred onto the transfer belt 15 and sequentially superimposed on the transfer belt 15.

The image forming apparatus 100 of the present embodiment includes four process units 10 including different color toners and expressed by 10*a*, 10*b*, 10*c*, and 10*d*. When the process units 10*a* to 10*d* are described without being distinguished from each other, they are referred to as the process unit 10. The process units 10*a* to 10*d* include the photoconductors 1*a* to 1*d*, the chargers 2*a* to 2*d*, the developing devices 4*a* to 4*d*, and the photoconductor cleaners 7*a* to 7*d*, respectively. In FIG. 1, the reference numerals of the chargers 2*b* to 2*d*, the developing devices 4*b* to 4*d*, and the photoconductor cleaners 7*b* to 7*d* are omitted. The following description when the color of toner is not referred uses the photoconductor 1, the charger 2, the developing device 4, and the photoconductor cleaner 7.

The photoconductor 1, which is an example of the image bearer, is a cylindrical drum-shaped photoconductor drum and rotates in a direction indicated by arrow in each of photoconductors 1*a* to 1*d* in FIG. 1.

Figure 2A:
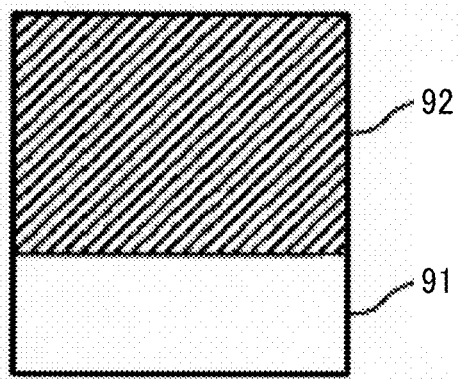
FIG. 2A is a schematic cross-sectional view of a photoconductor including a conductive support and a photosensitive layer containing inorganic particles overlying the surface of the conductive support.
Figure 2B:
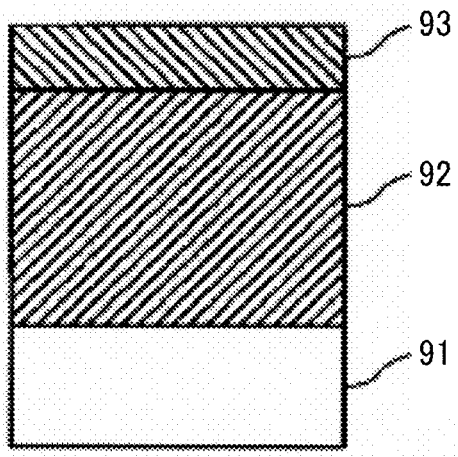
FIG. 2B is a schematic cross-sectional view of a photoconductor including the conductive support, the photosensitive layer on the conductive support, and a surface layer containing the inorganic particles on the photosensitive layer.
Figure 2C:
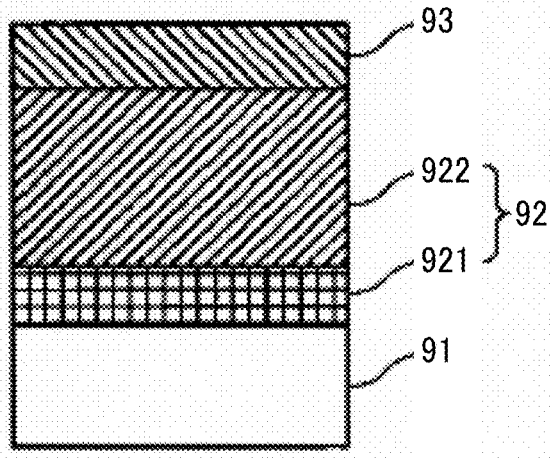
FIG. 2C is a schematic cross-sectional view of a photoconductor including the conductive support, the photosensitive layer made by laminating a charge generation layer and a charge transport layer on the conductive support, and the surface layer containing the inorganic particles on the photosensitive layer.
Figure 2D:
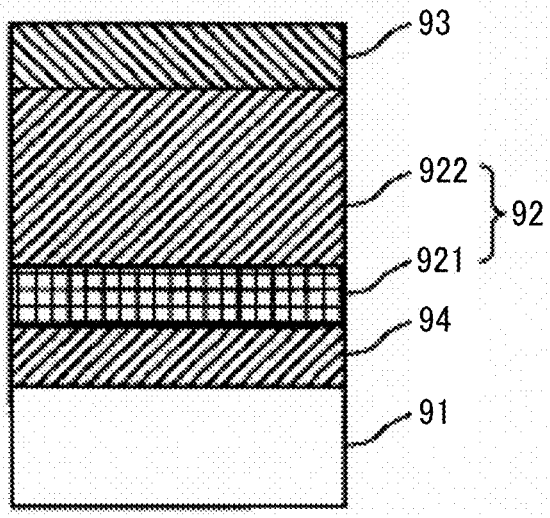
FIG. 2D is a schematic cross-sectional view of a photoconductor including, from the bottom, the conductive support, an undercoat layer, the photosensitive layer made by laminating the charge generation layer and the charge transport layer, and the surface layer containing the inorganic particles.

The following describes the photoconductor 1. FIGS. 2A to 2D are schematic cross-sectional views to describe the photoconductor 1. In the layer structure illustrated in FIG. 2A, the photoconductor 1 includes a conductive support 91 and a photosensitive layer 92 overlying the conductive support 91, and inorganic particles are contained in a part adjacent to the surface of the photosensitive layer 92. In the layer structure illustrated in FIG. 2B, the photoconductor 1 includes the conductive support 91 and the photosensitive layer 92 on the conductive support 91, and a surface layer 93 including the inorganic particles. FIG. 2C illustrates a layer structure including, from the bottom, the conductive support 91, the photosensitive layer 92, and the surface layer 93 including the inorganic particles; and the photosensitive layer 92 is constructed of a charge generation layer 921 and a charge transport layer 922. FIG. 2D illustrates a layer structure including, from the bottom, the conductive support 91, an undercoat layer 94, the photosensitive layer 92 constructed of the charge generation layer 921 and the charge transport layer 922, and the surface layer 93 including the inorganic particles.

The conductive support 91 may be made of material having a volume resistivity of $1\times10^{10}$ Ω·cm or less. For example, usable material includes plastic or paper having a film-like form or cylindrical form covered with a metal such as aluminum, nickel, chromium, nichrome, copper, gold, silver, and platinum, or a metal oxide such as tin oxide and indium oxide by vapor deposition or sputtering. In addition, the conductive support 91 may be produced by coating the above-described conductive support 91 with appropriate binder resin in which conductive powder is dispersed. Examples that are satisfactorily used as the conductive support 91 further include cylindrical supports coated with a heat-shrinkable tube, as a conductive layer, made of polyvinyl chloride, polypropylene, polyester, polystyrene, polyvinylidene chloride, polyethylene, chlorinated rubber, or TEFLON (trademark) further dispersing conductive powder therein.

The photosensitive layer 92 may have a single-layer structure or a laminate structure. The photosensitive layer 92 may be configured by the charge generation layer 921 and the charge transport layer 922.

The charge generation layer 921 includes a charge generation material as a main ingredient. The charge generation layer 921 may be made of a known material. Specific examples of the charge generation material in the charge generation layer 921 include, but are not limited to, monoazo pigments, disazo pigments, trisazo pigments, perylene pigments, perinone pigments, quinacridone pigments, quinone condensed polycyclic compounds, squaric acid dyes, phthalocyanine pigments, naphthalocyanine pigments, and azulenium salt dyes. These charge generation materials may be used alone or in combination.

The charge generation layer 921 may be formed by dispersing the charge generation material and an optional binder resin in a suitable solvent using a ball mill, an attritor, a sand mill, or ultrasonic and applying the liquid dispersion to the conductive support 91 followed by drying.

Specific examples of the binder resin optionally used in the charge generation layer 921 include, but are not limited to, polyamides, polyurethanes, epoxy resins, polyketones, polycarbonates, silicone resins, acrylic resins, polyvinylbutyrals, polyvinylformals, polyvinylketones, polystyrenes, polysulfone, poly-N-vinylcarbazoles, polyacrylamides, polyvinyl benzale, polyester, phenoxy resin, copolymer of vinylchloride and vinyl acetate, polyvinyl acetate, polyphenylene oxide, polyamide, polyvinylpyridine, cellulose-based resin, casein, polyvinyl alcohol, and polyvinylpyrrolidone.

The content of the binder resin is from 0 parts by weight to 500 parts by weight and preferably from 10 parts by weight to 300 parts by weight based on 100 parts by weight of the charge generation material.

The coating liquid may be coated by dip coating, spray coating, bead coating, nozzle coating, spinner coating, or ring coating. Preferably, the charge generation layer 921 has a film thickness of about 0.01 to 5 μm, more preferably 0.1 to 2 μm.

The charge transport layer 922 may be formed by dissolving or dispersing a charge transport material together with binder resin in a suitable solvent, applying the solution onto the charge generation layer 921, and drying it. If necessary, a plasticizer, a leveling agent, an antioxidant and the like may be added thereto. The charge transport material is classified as hole transport material or electron transport material. As the electron transport material and the hole transport material, known materials may be used.

Examples of the binder resin include thermoplastic or thermosetting resins, such as polystyrene, styrene-acrylonitrile copolymer, styrene-butadiene copolymer, styrene-maleic anhydride copolymer, polyester, polyvinyl chloride, vinyl chloride-vinyl acetate copolymer, polyvinyl acetate, polyvinylidene chloride, polyarylate, phenoxy resin, polycarbonate, cellulose acetate resin, ethyl cellulose resin, polyvinyl butyral, polyvinyl formal, polyvinyl toluene, poly-N-vinylcarbazole, acrylic resin, silicone resin, epoxy resin, melamine resin, urethane resin, phenol resin, and alkyd resin.

The content of the charge transport material is preferably from 20 parts by weight to parts by weight and more preferably from 40 parts by weight to 150 parts by weight, based on 100 parts by weight of the binder resin. The film thickness of the charge transport layer 922 is preferably equal to or smaller than 25 μm from the viewpoint of resolution and response. Depending on the system (in particular, charge potential) in use, the lower limit of the film thickness is preferably 5 μm or more. The charge transport layer 922 in the photoconductor 1 of the present embodiment may contain plasticizer or leveling agent. Specific examples of the plasticizer may include, but are not limited to, dibutyl phthalate and dioctylphthalate, that are known plasticizers generally used for resins. Preferably, the content of the plasticizer is about 0 to 30 parts by weight based on 100 parts by weight of the binder resin. Specific examples of the leveling agent may include, but are not limited to, silicone oil such as dimethyl silicone oil and methylphenyl silicone oil; polymer having a perfluoroalkyl group as lateral chains; or oligomers. The weight ratio of the leveling agent to the binder resin is preferably within a range from 0 to 1% by weight to the binder resin.

When the charge transport layer 922 serves as the surface layer, the inorganic particles are included in the charge transport layer 922. Examples of the inorganic particles include metal powder such as copper, tin, aluminum, and indium; metal oxide such as silicon oxide, silica, tin oxide, zinc oxide, titanium oxide, indium oxide, antimony oxide, bismuth oxide, tin oxide in which antimony is doped, and indium oxide in which tin is doped; and inorganic material such as potassium titanate. In particular, metal oxides are preferred. Furthermore, silicon oxide, aluminum oxide, and titanium oxide can be effectively used.

The inorganic particles preferably have an average primary particle diameter ranging from 0.01 μm to 0.5 μm, considering the characteristics of the surface layer 93 such as light transmittance and abrasion resistance. The inorganic particles having the average primary particle diameter 0.01 μm or smaller causes decrease in the abrasion resistance of the photoconductor and deterioration in the degree of dispersion in the surface layer. The inorganic particles having the average primary diameter 0.5 μm or greater easily sink in the dispersion liquid, and toner filming may occur on the surface of the photoconductor including the inorganic particles having the average primary diameter 0.5 μm or greater.

As the amount of inorganic particles added increases, abrasion resistance increases, which is desirable. However, if the amount of inorganic particles is extremely large, residual potentials may rise, and the degree at which writing light transmits a protective layer may decrease, resulting in side effects. The amount of the inorganic particles is preferably 30% by weight or less, more preferably 20% by weight or less, based on the total solid contents. The lower limit of the amount of the inorganic particles is preferably 3% by weight.

The above-described inorganic particles may be treated with at least one surface treatment agent, which is preferable for facilitating the dispersion of inorganic particles. Poorly dispersed inorganic particles in the surface layer cause not only an increase in the residual potential of the photoconductor but also deterioration in the transparency of the surface layer, occurrence of coating defects in the surface layer, and deterioration in the abrasion resistance of the surface layer. These may result in problems with regard to the durability of a resultant photoconductor and the quality of the images produced thereby.

Next, the photosensitive layer 92 having a single-layer structure is described.

The above-described charge generation material may be dispersed in the binder resin to make and use the photoconductor 1. A single-layer photosensitive layer 92 can be formed by application of a photosensitive layer coating liquid, followed by drying. The photosensitive layer coating liquid can be prepared by dissolving or dispersing the charge generation material, the charge transport material, and the binder resin in the solvent.

The single-layer photosensitive layer 92 serving as the surface layer 93 contains the above-described inorganic particles. Further, the photosensitive layer 92 may be a function separation type to which the above-described charge transport material is added, and can be favorably used. The coating liquid for the photosensitive layer 92 may further include a plasticizer, a leveling agent, and/or an antioxidant. Specific examples of the binder resin include those described above for the charge generation layer and the charge transport layer 922. Each of the binder resins may be used alone or in combination with others.

Based on 100 parts by weight of the binder resin, the content of the charge generation material is preferably from 5 to 40 parts by weight, and the content of the charge transport material is preferably from 0 to 190 parts by weight and more preferably from 50 to 150 parts by weight. A method of forming the single-layer photosensitive layer 92 may include, for example, dissolving or dispersing the charge generation material, the binder resin, and, if desired, the charge transport material in a solvent such as tetrahydrofuran, dioxane, dichloroethane, or cyclohexane with a disperser to prepare a coating liquid, and applying the coating liquid using a dip coating method, a spray coating method, or a bead coating method.

Preferably, the film thickness of the single-layer photosensitive layer 92 is about 5 to 25 μm.

The photoconductor 1 of the present embodiment may include the undercoat layer 94 between the conductive support 91 and the photosensitive layer 92. The undercoat layer 94 generally contains a resin as a main ingredient. Since the photosensitive layer 92 is formed by applying a solvent on the resin of the undercoat layer 94, the resin preferably has high solvent resistance to a general organic solvent.

Examples of such resins include, but are not limited to, water-soluble resins such as polyvinyl alcohol, casein, and sodium polyacrylate; alcohol-soluble resins such as copolymer nylon and methoxymethylated nylon; and curable resins that form a three-dimensional network structure, such as polyurethane, melamine resin, phenol resin, alkyd melamine resin, and epoxy resin.

In addition, the undercoat layer 94 may include fine powder pigments of metal oxide, such as titanium oxides, silica, alumina, zirconium oxides, tin oxides, and indium oxides to prevent moiré and reduce the residual potential. The undercoat layer 94 described above may be formed by using a suitable solvent and a suitable coating method as described above for the photosensitive layer 92. Silane coupling agents, titanium coupling agents, and chromium coupling agents may be used as the undercoat layer 94. Any other known materials and methods can be also available.

Preferably, the film thickness of the undercoat layer 94 is about 1 to 5 μm.

The photoconductor 1 of the present embodiment may include the surface layer 93 on the photosensitive layer 92.

The surface layer 93 includes inorganic particles. The surface layer 93 preferably includes binder resin in addition to the inorganic particles. Examples of the binder resin include thermoplastic resins such as polyarylate resin and polycarbonate resin, and cross-linked resins such as urethane resin and phenol resin.

Particles in the photoconductor may be either organic particles or inorganic particles. Examples of organic particles include fluorine containing resin particles and carbonaceous particles. Examples of inorganic particles include metal powder such as copper, tin, aluminum, and indium; metal oxide such as silicon oxide, silica, tin oxide, zinc oxide, titanium oxide, indium oxide, antimony oxide, bismuth oxide, tin oxide in which antimony is doped, and indium oxide in which tin is doped; and inorganic material such as potassium titanate. In particular, metal oxides are preferred. Furthermore, silicon oxide, aluminum oxide, and titanium oxide can be effectively used.

The inorganic particles preferably have an average primary particle diameter ranging from 0.01 μm to 0.5 μm, considering the characteristics of the surface layer 93 such as light transmittance and abrasion resistance. The inorganic particles having the average primary particle diameter 0.01 μm or smaller causes decrease in the abrasion resistance of the photoconductor and deterioration in the degree of dispersion in the surface layer. The inorganic particles having the average primary diameter 0.5 μm or greater easily sink in the dispersion liquid, and toner filming may occur on the surface of the photoconductor including the inorganic particles having the average primary diameter 0.5 μm or greater.

As the concentration of inorganic particles in the surface layer 93 added increases, abrasion resistance increases, which is desirable. However, if the concentration of inorganic particles is extremely large, residual potentials may rise, and the degree at which writing light transmits a protective layer may decrease, resulting in side effects. The amount of the inorganic particles is preferably 50% by weight or less, more preferably 30% by weight or less, based on the total solid contents. The lower limit is preferably 5% by weight. The above-described inorganic particles may be treated with at least one surface treatment agent, which is preferable for facilitating the dispersion of inorganic particles. Poorly dispersed inorganic particles in the surface layer may cause not only an increase in the residual potential of the photoconductor but also deterioration in the transparency of the surface layer, occurrence of coating defects in the surface layer, and, deterioration in the abrasion resistance of the surface layer. These may result in problems with regard to the durability of a resultant photoconductor and the quality of the images produced thereby.

A typical surface treatment agent may be used for the photoconductor in the present embodiment. It is preferable that the surface treatment agent can maintain insulation of inorganic particles. Examples of the surface treatment agent include titanate coupling agents, aluminum coupling agents, zircoaluminate coupling agents, higher fatty acids, mixtures of silane coupling agents and those, $Al_2O_3$, $TiO_2$, $ZrO_2$, silicone, aluminum stearate, and mixtures of two or greater of them. The above examples are preferable to attain preferable dispersion of inorganic particles and inhibition of image blurring.

Treatment on inorganic particles by the silane coupling agent has an adverse impact with regard to production of blurred images. However, a combinational use of the surface treatment agent specified above and the silane coupling agent may lessen this adverse impact.

The amount of surface treatment is preferably from 3% by weight to 30% by weight and, more preferably, from 5% by weight to 20% by weight although it depends on the mean primary particle diameter of inorganic particle. The surface treatment amount within this range gives the effect of dispersion of the inorganic particles and enables to prevent the residual potential from significantly increasing. The above-mentioned inorganic particles may be used alone or in combination.

The film thickness of the surface layer 93 is preferably within a range from 1.0 μm to 8.0 μm.

Preferably, the photoconductor 1 that is repeatedly used for a long time has a high mechanical durability and does not easily abrade. However, the charger in the image forming apparatus 100 generates gasses such as ozone and NOx gas. The gasses generate chemical compounds, and adhesion of the chemical compounds to the surface of the photoconductor 1 may cause image deletion. In order to prevent the image deletion from occurring, it is preferable to wear the photosensitive layer 92 at a certain constant speed or more. Accordingly, for the repeated use for a long time, the film thickness of the surface layer 93 is preferably 1.0 μm or greater. In addition, the film thickness of the surface layer 93 is preferably equal to or greater than 8.0 μm to prevent the residual potential from rising and a micro dot reproducibility from deteriorating.

The material of inorganic particles is dispersed in the dispersion liquid by using a suitable dispersing device. The average particle diameter of the inorganic particles in the dispersion liquid is preferably 1 μm or less, and more preferably 0.5 μm or less, from the viewpoint of the transmittance of the surface layer 93.

A method to provide the surface layer 93 on the photosensitive layer 92 may be a dip coating method, a ring coating method, a spray coating method, or the like. Among these methods, a typical method for forming the surface layer 93 is the spray coating method in which the coating material is ejected as mist from nozzles having micro openings, and micro droplets of the mist adhere to the photosensitive layer 92, forming a coating layer. Specific examples of usable solvents include, but are not limited to, tetrahydrofuran, dioxane, toluene, dichloromethane, monochlorobenzene, dichloroethane, cyclohexanone, methyl ethyl ketone, and acetone.

The surface layer 93 may include the charge transport material to reduce the residual potential and improve the response. The charge transport material is described in the description of the charge transport layer 922. When low-molecular electric charge transport materials are used as the electric charge transport material, there may be a density inclination in the surface layer 93.

An example of the material preferably used for the surface layer 93 is polymeric charge transport material having functions of the charge transport material and binder resin. The surface layer 93 made from such polymeric charge transport material has excellent abrasion resistance. Materials known as the polymeric charge transport material may be used. The polymeric charge transport material is preferably at least a polymer selected from polycarbonate, polyurethane, polyester, and polyether. In particular, polycarbonate having a triarylamine structure in the main chain, side chain, or both is preferable.

The elastic power or the Martens hardness of the surface layer 93 of the photoconductor 1 is appropriately controlled by the addition amount of inorganic particles and the resin type. Incorporating a rigid structure into the resin skeleton increases the elastic power and the Martens hardness of resins such as polycarbonate and polyarylate. Employing the polymeric charge transport material described above increases the elastic power and the Martens hardness.

That is, the elastic power of the photoconductor 1 may be adjusted by changing at least one of the amount of the inorganic particles and the type of resin in the outermost surface layer of the photoconductor 1 as described above, but an adjusting method of the elastic power of the photoconductor 1 is not limited to this and may be appropriately changed.

The charger 2 is a charging device to charge the photoconductor 1 and has a roller shape. The charger 2 is pressed against the surface of the photoconductor 1 and rotated by the rotation of the photoconductor 1. A high voltage power supply applies a bias voltage produced by a direct current (DC) or an alternating current (AC) superimposed on the direct current to the charger 2. Thus, the charger 2 uniformly charges the photoconductor 1.

In the present embodiment, the charger 2 is a roller type charging device but not limited to this. For example, the charger 2 may be a wire type charging device.

An exposure device 3 is a latent image forming device. The exposure device 3 emits light to irradiate the surface of the photoconductor 1 and form an electrostatic latent image on the photoconductor 1 based on image data. The exposure device 3 may be a laser beam scanner using a laser diode or light emitting diodes (LEDs).

The developing device 4 has toner (that is, developer) to visualize the electrostatic latent image on the photoconductor 1 as a toner image. The developing device 4 develops an image with a predetermined developing bias supplied from, for example, a high voltage power supply.

The photoconductor cleaner 7 includes a photoconductor cleaning blade 6 therein and cleans the photoconductor 1. The photoconductor cleaners 7*a* to 7*d* include photoconductor cleaning blades 6*a* to 6*d*, respectively, and reference numerals 6*b* to 6*d* are omitted in FIG. 1.

The transfer belt 15 is stretched by a transfer drive roller 21, a cleaning counter roller 16, primary transfer rollers 5, and a tension roller 20. A drive motor drives to rotate the transfer belt 15 via the transfer drive roller 21 in a direction indicated by arrow in FIG. 1. As a mechanism for stretching the transfer belt 15, springs press both sides of the tension roller 20.

The transfer belt 15 (including an intermediate transfer belt or the like) may have either a multi-layer structure or a single-layer structure.

Examples of material of the transfer belt 15 include polyimide (PI), polyamideimide (PAI), thermoplastic polyimide (TPI), polyvinylidene fluoride (PVDF), and polyether ether ketone (PEEK). In addition, polycarbonate (PC), polyphenylene sulfide (PPS), or the like may be used.

Polyimide (PI) and polyamideimide (PAI) are thermosetting resin molded by centrifugal molding or the like. Since these resins cannot be continuously molded, producing the transfer belt 15 takes many man-hours, which increases cost. In contrast, TPI, PVDF, PEEK, PC, PPS, and the like are thermoplastic that can be subjected to extrusion molding. Since these resins can be continuously molded, the transfer belt 15 can be efficiently produced, which reduces the cost. TPI is preferable in the characteristics (hardness and elastic power) of the transfer belt 15. The transfer belt 15 made of TPI is low cost, has high durability and is used as a long life transfer belt.

The transfer belt 15 may contain a conductive material that gives conductivity to the transfer belt 15. An Example of the conductive material generally includes conductive fillers. Examples of the conductive fillers include metal fillers, metal oxide fillers, metal-coated fillers, and carbon fillers.

The metal fillers (made of Ag, Ni, Cu, Zn, Al, stainless steel, etc.) have the highest conductivity in the conductive fillers, and attention should be paid when the transfer belt 15 having high resistance is produced. In addition, it should be noted that materials except expensive Au and Ag are easily oxidized and may change the resistance values.

Metal oxide fillers (made of SnO2, In2O3, ZnO) are preferably included in an amount of 10 to 50% by weight based on the total amount of the resins in order to obtain conductivity, and it is noted that mechanical properties of the polymer may be deteriorated. It is also noted that the metal oxide fillers may be high cost materials.

Carbon fillers are inexpensive and can be controlled in a medium to high resistance range.

In general, conductive carbon which is relatively inexpensive and less susceptible to environmental dependence is suitable as the conductive material. The conductive carbon includes furnace black, channel black, acetylene black, Ketjen black and the like depending on its production method. A conductive belt is often made of furnace black, acetylene black.

The transfer belt 15 containing the conductive material and the semi-aromatic crystalline thermoplastic polyimide having a melting point of 360° C. or less can reduce cost. In particular, the low cost transfer belt 15 contains the conductive material, the semi-aromatic crystalline thermoplastic polyimide having the melting point of 360° C. or less, and at least one selected from the following first group. (First group:Polyetheramide, thermoplastic polyamideimide, PEEK)

The hardness and elastic power of the transfer belt 15 are affected by molding conditions and the composition such as the type and amount of carbon in addition to the characteristics unique to the materials. In particular, the hardness and elastic power of the transfer belt 15 are affected by a cooling rate during molding. The lower the cooling rate is, the higher the hardness is. The cooling rate can be controlled by controlling the temperature of a mandrel, a drawing speed of the belt, or the like. In addition, the hardness may be increased by annealing treatment after molding.

Accordingly, the elastic power of the transfer belt 15 may be adjusted by, for example, changing the type or amount of the conductive carbon or the molding condition in addition appropriately selecting the type of the material to be used.

The transfer drive roller 21 is also referred to as a secondary-transfer backup roller, and functions as a backup roller for a secondary transfer.

The driving source of the process unit 10 and the driving source of the transfer drive roller 21 may be independent from each other or may be common to each other. However, it is preferable that the driving source of the process unit 10 and the driving source of the transfer drive roller 21 are common to each other from the viewpoint of reduction in size and cost of an image forming apparatus main body. In addition, preferably, at least the driving source of the process unit 10 for black and the driving source of the transfer drive roller 21 are common, and they are simultaneously turned on and off.

A transfer belt cleaner 32 includes a cleaning blade 31 that is brought into counter contact with the transfer belt 15. The cleaning blade 31 scrapes off transfer residual toner and the like on the transfer belt 15 to clean the transfer belt 15.

A cleaning method to clean the transfer belt 15 is not limited to the blade cleaning method, but may be an electrostatic method using a brush or a roller. The electrostatic method uses, for example, a cleaning brush or a cleaning roller to which a bias is applied instead of the cleaning blade 31. The electrostatic method may require pre-charging the transfer residual toner depending on the use state of the image forming apparatus, which increases the size of the cleaner. To use the electrostatic method, one or two high-voltage power sources may be added to the image forming apparatus, and the image forming apparatus may perform an additional operation for bias cleaning. The blade cleaning method is preferable from the viewpoints of downsizing of the apparatus main body, cost reduction, and cleaning performance.

The transfer residual toner scraped off by the cleaning blade 31 is conveyed through a toner conveyance passage and stored in a waste toner storage 33 for an intermediate transferor.

The primary transfer rollers 5 is disposed to face the photoconductors 1 via the transfer belt 15. For example, a single high-voltage power supply applies a predetermined primary transfer bias to the primary transfer rollers 5, thereby transferring the toner image on the photoconductor 1 to the transfer belt 15.

The image forming apparatus 100 according to the present embodiment includes primary transfer rollers 5*a* to 5*d*, and reference numerals 5*b* to 5*d* are omitted in FIG. 1. When the primary transfer rollers 5*a* to 5*d* are described without being distinguished from each other, they are referred to as the primary transfer rollers 5.

The primary transfer roller 5 may be appropriately selected. For example, the primary transfer roller 5 may be a metal roller made of aluminum, steel use stainless (SUS), or the like, an ion conductive roller made of a material in which urethane and carbon are dispersed, acrylonitrile butadiene rubber (NBR), hydrin rubber, or the like, and an electron conductive type roller made of ethylene propylene diene rubber (EPDM) or the like.

In the present embodiment, the toner image on the photoconductor 1 is transferred to the transfer belt 15, which is referred to as primary transfer, and the toner image on the transfer belt 15 is transferred to a transfer material (that is, a recording medium), which is referred to as secondary transfer.

The secondary transfer is performed by, for example, a roller system or a belt system. The image forming apparatus 100 in the present embodiment employs the roller system using the secondary transfer roller 25 as illustrated in FIG. 1.

The secondary transfer roller 25 may be, for example, an ion conductive roller made of a material in which urethane and carbon are dispersed, acrylonitrile butadiene rubber (NBR), hydrin rubber, or the like and an electron conductive type roller made of ethylene propylene diene rubber (EPDM) or the like.

The belt system for the secondary transfer uses a secondary transfer belt stretched on a roller disposed at the position of the secondary transfer roller 25 and other rollers. The drive motor drives to rotate one of the rollers that rotates the secondary transfer belt.

A cleaner may be disposed to clean the secondary transfer roller 25. The cleaner to clean the secondary transfer roller 25 may be, for example, a cleaning blade that is brought into counter contact with the secondary transfer roller 25. Similarly, the cleaner may be disposed on the secondary transfer belt.

The transfer material 26 (that is the recording medium) is set in a transfer material cassette 22 or a manual insertion port 42. A sheet feed conveyance roller 23 and a registration roller pair 24 feed and convey the set transfer material to a secondary transfer position, timed to coincide with the arrival of the tip of the toner image on the surface of the transfer belt 15 to the secondary transfer position. To perform the secondary transfer, for example, a high voltage power supply applies a predetermined secondary transfer bias to the secondary transfer roller 25 or the transfer drive roller 21 to transfer the toner image on the transfer belt 15 onto the transfer material 26.

As an application method of the secondary transfer bias, an attraction transfer method and a repulsive force transfer method may be selected. In the attraction transfer method, the high voltage power applies a positive (+) bias voltage to the secondary transfer roller 25, and the transfer drive roller 21 is grounded to form a secondary transfer electric field. In the repulsive force transfer method, the high voltage power supply applies a negative (−) bias voltage to the transfer drive roller 21, and the secondary transfer roller 25 is grounded to form the secondary transfer electric field.

In the present exemplary embodiment, the sheet feeding passage is a vertical passage, but is not limited to this, and may be appropriately changed. The transfer material 26 is separated from the transfer belt 15 by the curvature of the transfer drive roller 21 and is conveyed to a fixing device 40. After the fixing device 40 fixes the toner image transferred onto the transfer material 26, the transfer material 26 is ejected from an ejection port 41.

Next, the following describes details of the present embodiment.

As described above, in the present embodiment, the visible image is transferred from the photoconductor as the image bearer to the transfer belt as the transferor, and the visible image on the transfer belt is fixed to the recording medium to form the image.

In such a transfer belt, foreign substances such as paper dust, silica that is an external additive contained in the toner, and a lubricant adhere to the transfer belt and are fixed to the transfer belt by the external pressure that is mainly contact pressure with the photoconductor. As a result, filming (that is adhesion of foreign substances) occurs on the transfer belt. Since the occurrence of the filming inhibits high quality image formation, preventing the occurrence of the filming is required.

As a result of intensive studies, the present inventors have focused on a relationship between elastic powers of the transferor and the image bearer, and have found that setting the following relationship between the elastic powers can prevent the adhesion of foreign substances such as paper dust to the transferor in spite of the existence of contact pressure of the image bearer against the transferor.

In the present embodiment, the elastic power of the transferor is set larger than the elastic power of each of the plurality of image bearers. This relationship may be expressed as follows:

Elastic power of the transferor>Elastic power of each of the plurality of image bearers, which is referred to as an expression (a).

In the present disclosure, a load is applied to the transferor and the image bearer to deform the transferor and the image bearer, and a workload of elastic deformation and a workload of plastic deformation are obtained in each of the transferor and the image bearer. The elastic power is a ratio of the workload of elastic deformation to a sum of the workload of plastic deformation and the workload of elastic deformation and is expressed as a percentage by the following expression.

$$\text{Elastic power [\%]}=\{\text{workload of elastic deformation}/(\text{workload of plastic deformation}+\text{workload of elastic deformation})\}\times 100$$

An object having a large elastic power is easy to return to its original shape after deformation and is difficult to plastically deform.

In the present embodiment, the elastic power of the transferor and the image bearer was measured by the following method.

Measuring instrument: a microhardness tester H-100 available from Fischer Instruments K.K.

Measurement conditions: Maximum load 2 mN

Time from initial load to maximum load: 10 seconds

Creep time: 10 seconds

Time to decrease load: 10 seconds

Measurement environment: 23° C., 50%

Figure 3:
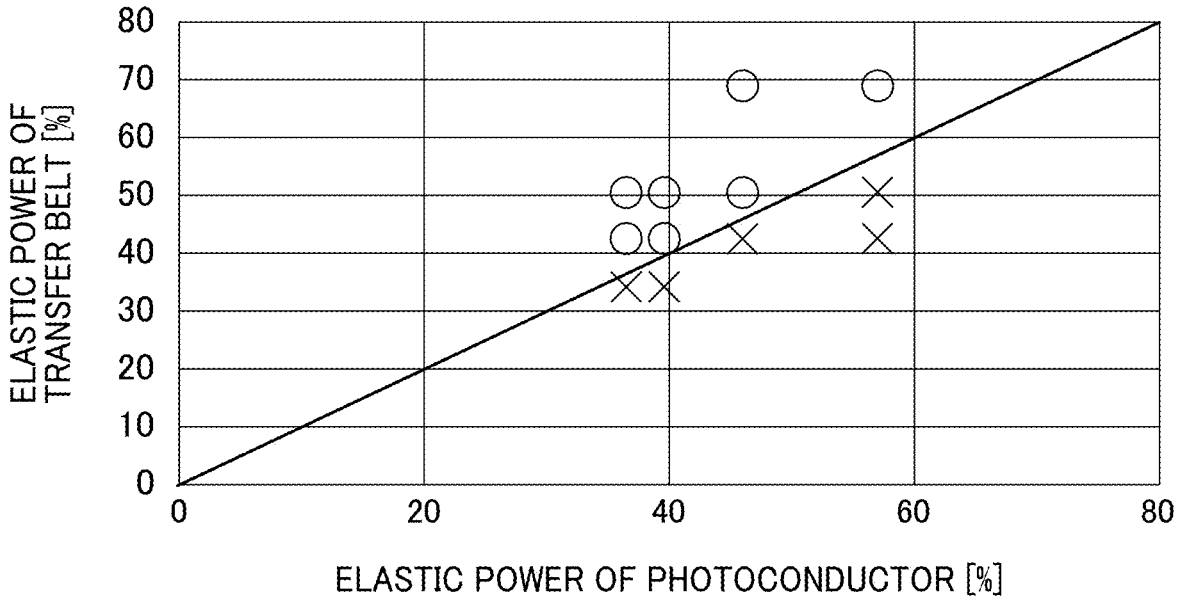
FIG. 3 is a graph illustrating results of experiments that investigated whether filming occurs or not under different elastic powers [%] of photoconductors and different elastic powers [%] of transfer belts.

Table 1 and FIG. 3 illustrate results of experiments that investigated a relationship between the elastic power of the transferor, the elastic power of the image bearer, and the occurrence of filming. Table 1 is the results of examining the presence or absence of filming on the transfer belt when the elastic power [%] of the photoconductor and the elastic power [%] of the transfer belt were changed. Table 1 was turned into a graph that is FIG. 3.

The following describes an evaluation method of the filming. The filming on the transfer belt was evaluated after the image forming apparatus MPC3503 manufactured by Ricoh Co., Ltd. repeated 3000 print operations in which the image forming apparatus MPC3503 printed an image having an image density 0.5% on each of three sheets continuously and completed printing, that is, totally printed the image on 9000 sheets, under a high temperature of 32° C. and a high humidity of 54%. The photoconductors and the transfer belt having the elastic powers listed on Table 1 were set in the image forming apparatus. When the substances did not adhere to the photoconductor after 9000 sheets were printed as described above, the filming on the transfer belt was evaluated as an acceptable level and expressed by "good" in Table 1 and a white circle in FIG. 3. When the substances adhered to the photoconductor after 9000 sheets were printed as described above, the filming on the transfer belt was evaluated as a non-acceptable level and expressed by "poor" in Table and "x" in FIG. 3.

The elastic power of the transfer belt was adjusted by changing the type of material and the type and amount of conductive carbon contained therein. The elastic power of the photoconductor was adjusted by changing the addition amount of the inorganic particles and the kind of resin that were contained in the outermost surface layer of the photoconductor.

TABLE 1

| | Sample 1 | Sample 2 | Sample 3 | Sample 4 |
|---|---|---|---|---|
| Elastic power of the photoconductor | 36.5 | 36.5 | 36.5 | 39.6 |
| Elastic power of transfer belt | 34.2 | 42.5 | 50.5 | 34.2 |
| Filming | poor | good | good | poor |
| | Sample 5 | Sample 6 | Sample 7 | Sample 8 |
| Elastic power of the photoconductor | 39.6 | 39.6 | 46 | 46 |
| Elastic power of transfer belt | 42.5 | 50.5 | 42.5 | 50.5 |
| Filming | good | good | poor | good |
| | Sample 9 | Sample 10 | Sample 11 | Sample 12 |
| Elastic power of the photoconductor | 46 | 57 | 57 | 57 |
| Elastic power of transfer belt | 68.9 | 42.5 | 50.5 | 68.9 |
| Filming | good | poor | poor | good |

As illustrated in Table 1 and FIG. 3, setting the elastic power of the transferor larger than the elastic power of the image bearer prevented adherence of substances due to the pressure from the photoconductor and reduced the filming.

In addition to the above, the elastic powers of the plurality of image bearers in the present embodiment are set as follows. In the present embodiment, the difference in elastic power between the transferor and the most upstream image bearer of the plurality of the image bearers in the rotation direction of the transferor is set to be smaller than the difference in elastic power between the transferor and any other image bearer except the most upstream image bearer of the plurality of image bearers. The most upstream image bearer is, for example, the photoconductor 1*a* illustrated in FIG. 1.

The above difference may be expressed by the following expression. In the following expression, the unit (%) is omitted.

Difference=Elastic power of transferor−Elastic power of image bearer

The above-described relationship between the difference in elastic power between the transferor and the most upstream image bearer of the plurality of image bearers and the difference in elastic power between the transferor and any other image bearer except the most upstream image bearer may be expressed by the following expression.

The difference in elastic power between the transferor and the most upstream image bearer of the plurality of image bearers<the difference in elastic power between the transferor and any other image bearer except the most upstream image bearer of the plurality of image bearers, which is referred to as an expression (b).

In the example illustrated in FIG. 1, the difference between the elastic power of the transfer belt 15 and the elastic power of the photoconductor 1*a* is smaller than the difference between the elastic power of the transfer belt 15 and the elastic power of each of the photoconductors 1*b* to 1*d* (that is, for example, the difference between the elastic power of the transfer belt 15 and the elastic power of the photoconductor 1*b*).

The above relationship may be restated as follows. That is, the elastic power of the transferor is larger than the elastic power of each of the plurality of image bearers, and the elastic power of the most upstream image bearer of the plurality of image bearers is larger than the elastic power of any other image bearer except the most upstream image bearer of the plurality of image bearers. This relationship may be expressed by the following expression.

Elastic power of the transferor>Elastic power of each of the plurality of image bearers, and Elastic power of the most upstream image bearer of the plurality of image bearers>Elastic power of any other image bearer except the most upstream image bearer of the plurality of image bearers.

The substances such as toner additives are transferred from the photoconductor to the transfer belt used in the image forming apparatus. The amount of the substances transferred to the transfer belt increases as the transfer belt moves downstream in the rotation direction of the transfer belt. Accordingly, it is considered that the influence of filming increases toward the downstream side in the rotation direction. Satisfying the expression (a) and the expression (b) can prevent the adherence of the substances due to the pressure from the photoconductor despite the increase in the amount of the substances on the downstream side.

With reference to FIG. 1, the present embodiment is further described. As described above, the elastic power represents elastically deformable level, that is, the ease or difficulty of elastic deformation and plastically deformation level, that is, the ease or difficulty of plastic deformation. The object having the large elastic power is easy to return to its original shape after deformation. In the present embodiment, the elastic power of the transfer belt 15 is set to be larger than the elastic power of each of the photoconductors 1*a* to 1*d*, and the difference in elastic power between the transfer belt 15 and the photoconductor 1*a* is set to be smaller than the difference in elastic power between the transfer belt 15 and each of the photoconductors 1*b* to 1*d*.

The difference in elastic power between the transfer belt 15 and the photoconductor 1*a* that is the most upstream image bearer of the plurality of image bearers is set to be smaller than the difference in elastic power between the transfer belt 15 and each of the photoconductors 1*b* to 1*d*. That is, the difference in elastic deformation level (that is, the ease of elastic deformation) between the transfer belt 15 and the photoconductor 1*a* is smaller than the difference in elastic deformation level between the transfer belt 15 and each of the photoconductors 1*b* to 1*d*. The substances on the most upstream portion of the transfer belt 15 in which the photoconductor 1*a* as the most upstream image bearer contacts the transfer belt 15 is less than the substances on a downstream portion of the transfer belt 15 that is downstream from the most upstream portion in the rotation direction of the transfer belt 15. Accordingly, the influence of the substances that occurs between the photoconductor 1*a* and the transfer belt 15 contacting the photoconductor 1*a* on the most upstream portion is smaller than the influence of the substances on the downstream portion.

In contrast, the difference in elastic power between the transfer belt 15 and each of the photoconductors 1 *b* to 1*d* downstream the photoconductor 1*a* is set to be larger than the difference in elastic power between the transfer belt 15 and the photoconductor 1*a* on the most upstream portion. That is, the elastic deformation level of the downstream portion of the transfer belt 15 is larger than the elastic deformation level of the upstream portion of the transfer belt 15. The amount of the substances on the downstream portion of the transfer belt 15 is larger than the amount of the substances on the most upstream portion of the transfer belt 15. However, the above-described configuration enables the transfer belt 15 to contact the photoconductors so as to easily return to its original state even when the transfer belt 15 is deformed by the influence of the substances. As a result, the above-described configuration can prevent the filming.

As described above, since the amount of substances on the transfer belt 15 increases toward the downstream side, the margin for filming decreases. However, as the difference in elastic power between the transferor and the image bearer increases, the margin for filming increases. Therefore, setting the above-described relationship can prevent filming on the transferor. On the other hand, satisfying the expression (a) but not satisfying the expression (b) causes a filming on the image bearer on the downstream side, in particular, on the image bearer on the most downstream side. As a result, it becomes difficult to obtain good image quality, and the image quality deteriorates over time.

The number of image bearers is not limited to the number of image bearers of the present embodiment and may be appropriately changed to be two or more. Two or more image bearers, for example, two image bearers can satisfy the above-described expressions (a) and (b).

In the present embodiment, preferably, the difference in elastic power between the transferor and one of the plurality of image bearers is larger than the difference in elastic power between the transferor and the image bearer upstream from the one of the image bearer in the rotation direction of the transferor. For example, in the example illustrated in FIG. 1, preferably, the difference in elastic power between the photoconductor 1*a* and the transfer belt 15 is the smallest, and the difference in elastic power between the photoconductor 1*b* and the transfer belt 15, the difference in elastic power between the photoconductor 1*c* and the transfer belt 15, and the difference in elastic power between the photoconductor 1*d* and the transfer belt 15 increases in this order toward the downstream side. Since the number of times of contact of the transfer belt with the photoconductor increases toward the downstream side in the rotation direction (downstream side in the conveyance direction), the amount of substances on the transfer belt increases accordingly. The above-described configuration can reduce the amount of substances adhering to the transfer belt and further prevent the filming on the transfer belt.

In the present embodiment, the elastic power of the transferor is preferably 30% or more. The above-described configuration can prevent the transferor from being recessed and not returning and prevent the substances from sticking into the transferor. As a result, filming can be prevented without adhesion of the substances to the transferor.

In the present embodiment, the elastic power of the transferor is preferably 70% or less. The above-described configuration can prevent the transferor from being easily recessed and reduce foreign matters such as toner passing through the cleaning blade or the like when a cleaning process is performed. Therefore, the cleaning property can be improved.

Second Embodiment

Next, a description is given of another image forming apparatus according to a second embodiment of the present disclosure. Descriptions of matters similar to the first embodiment is omitted.

An image forming apparatus according to the present embodiment includes a plurality of image bearers and a transferor to which images borne by the plurality of image bearers are transferred. An elastic power of the transferor is larger than an elastic power of each of the plurality of image bearers, and a difference in elastic power between the transferor and the image bearer bearing a black image, that is, a black image bearer, is larger than a difference in elastic power between the transferor and any other image bearer except the black image bearer.

Generally, in the market, the monochrome mode is more frequently used than the color mode. Accordingly, in the monochrome mode that is more frequently used than the color mode, the transfer belt is susceptible to paper dust and silica. Therefore, in the present embodiment, the relationship between the elastic powers of the plurality of image bearers is defined by focusing on the relationship between the elastic powers of the black image bearer and another image bearer.

In the present embodiment, similar to the first embodiment, the elastic power of the transferor (for example, the transfer belt) is set larger than the elastic power of each of the plurality of image bearers. This can be expressed by the following expression as in the first embodiment.

Elastic power of the transferor>Elastic power of each of the plurality of image bearers, that is the expression (a).

In addition, similar to the first embodiment, the difference in elastic power between the transferor and the image bearer may be expressed by the following expression.

Difference=Elastic power of transferor−Elastic power of image bearer

In the second embodiment, the difference in elastic power between the transferor and the black image bearer is set to be larger than the difference in elastic power between the transferor and any other image bearer except the black image bearer. This relationship may be expressed as follows:

The difference in elastic power between the transferor and the black image bearer>the difference in elastic power between the transferor and any other image bearer except the black image bearer, which is referred to as an expression (c).

That is, the image forming apparatus in the second embodiment satisfies the expressions (a) and (c). The above-described configuration can prevent the filming (that is, adhesion of foreign substances) from occurring on the transferor to which an image is transferred from the image bearer that is frequently used.

When the difference in elastic power between the transferor and the black image bearer is set to be larger than the difference in elastic power between the transferor and any other image bearer except the black image bearer, the elastic deformation level of the transferor at a position at which the black image bearer contacts the transferor is larger than the elastic deformation level of the transferor at a position at which the image bearer not bearing the black image contacts the transferor. The above-described configuration enables the transferor to contact the black image bearer frequently used so as to easily return to its original state even when the transferor is deformed by the influence of the substances. As a result, the above-described configuration can prevent the filming.

In the example illustrated in FIG. 1, the black image bearer may be any of the photoconductor 1*a* to 1*d*.

The above relationship may be restated as follows. That is, the elastic power of the transferor is larger than the elastic power of each of the plurality of image bearers, and the elastic power of the black image bearer is smaller than the elastic power of any other image bearer except the black image bearer. This relationship may be expressed by the following expression.

Elastic power of the transferor>Elastic power of each of the plurality of image bearers, and Elastic power of the black image bearer>Elastic power of any other image bearer except the black image bearer.

As described above, since a black mode use rate is higher than a color mode use rate in the market, setting the difference in elastic power between the transferor and the black image bearer to be larger than the difference in elastic power between the transferor and any other image bearer except the black image bearer can prevent the filming on the transferor. On the other hand, satisfying the expression (a) but not satisfying the expression (c) causes a filming on the black image bearer. As a result, it becomes difficult to obtain good image quality, and the image quality deteriorates over time.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

What is claimed is:

1. An image forming apparatus comprising:

a plurality of image bearers; and a rotatable transferor to which images borne on the plurality of image bearers are transferred, the transferor having an elastic power larger than an elastic power of each of the plurality of image bearers and wherein a difference in elastic power between the transferor and a most upstream image bearer of the plurality of image bearers in a rotation direction of the transferor is smaller than a difference in elastic power between the transferor and any other image bearer except the most upstream image bearer of the plurality of image bearers.

2. The image forming apparatus according to claim 1, wherein a difference in elastic power between the transferor and each of the plurality of image bearers increases toward downstream in the rotation direction of the transferor.

3. The image forming apparatus according to claim 1, wherein the elastic power of the transferor is 30% or more.

4. The image forming apparatus according to claim 1, wherein the elastic power of the transferor is 70% or less.

5. The image forming apparatus according to claim 1, wherein the transferor is a transfer belt, and the plurality of image bearers are photoconductors.

6. An image forming apparatus comprising:

a plurality of image bearers including a black image bearer configured to bear a black image; and a transferor to which images borne on the plurality of image bearers are transferred, the transferor having an elastic power larger than an elastic power of each of the plurality of image bearers and wherein a difference in elastic power between the transferor and the black image bearer is larger than a difference in elastic power between the transferor and any other image bearer except the black image bearer.

7. The image forming apparatus according to claim 6, wherein the elastic power of the transferor is 30% or more.

8. The image forming apparatus according to claim 6, wherein the elastic power of the transferor is 70% or less.

9. The image forming apparatus according to claim 6, wherein the transferor is a transfer belt, and the plurality of image bearers are photoconductors.

* * * * *